United States Patent [19]

Nemcovsky

[11] Patent Number: 5,061,202

[45] Date of Patent: Oct. 29, 1991

[54] CONNECTOR

[75] Inventor: Rhonda L. Nemcovsky, Warren, Pa.

[73] Assignee: GTE Products Corporation, Stamford, Conn.

[21] Appl. No.: 679,386

[22] Filed: Apr. 2, 1991

[51] Int. Cl.[5] ..... H01R 4/24
[52] U.S. Cl. ..... 439/404
[58] Field of Search ..... 439/389–425

[56] References Cited

U.S. PATENT DOCUMENTS 4,278,314 7/1981 Moser et al. ..... 439/404
4,679,880 7/1987 Pitsch ..... 439/404

*Primary Examiner*—Joseph H. McGlynn
*Attorney, Agent, or Firm*—W. H. McNeill

[57] ABSTRACT

A connector including a pair of electrically joined upper contacts which form a nip with a corresponding pair of electrically joined lower contacts for electrically mating therebetween an upper and lower surface of a pair of respective wires.

19 Claims, 4 Drawing Sheets

CONNECTOR

BACKGROUND OF THE INVENTION

1. Field of the Invention

The present invention relates to an electrical connector which can be connected to an insulated or non-insulated multiple wire cable to mate wires thereof.

2. Description of the Prior Art

Connectors for use with single wire cables are known. For example, insulation displacement connection (IDC) contacts are standard contacts which mate with various gage wires. Such IDC contacts include a relatively flat piece of contact material with a U-shaped slot. The top or lead-in edge of the slot has the ability to pierce the insulation on a wire as the wire is forced into the slot. Subsequently, the wire is forced further into the slot making electrical contact with the sides of the U-shaped surface. Such a IDC contact is used to mate to one wire lead at a time.

It is desirable to provide a connector which allows mating to two wire leads at a time.

It is further desirable to provide such a connector which allows mating to more than two wire leads at a time.

It is also desirable to provide a connector which allows mating to a plurality of wire leads at a time and includes a plurality of contacts bussed together.

It is further desirable to provide a connector which allows mating to a plurality of wire leads at a time and includes a plurality of pairs of contacts which are bussed together.

It is also desirable to provide a connector which will mate with two wire leads which are separated by a third lead.

SUMMARY OF THE INVENTION

This invention achieves these and other results by providing a connector for use with at least one multiple wire cable of the type which comprises at least two wires. The connector comprises an upper connector means positioned within a housing and including at least one upper first contact for electrically engaging an upper surface of a respective first wire, and at least one upper second contact electrically coupled to, and positioned to provide an upper open area relative to, such upper first contact for electrically engaging an upper surface of a respective second wire. A lower connector means is positioned within the housing and includes at least one lower first contact for electrically engaging a lower surface of a respective first wire, and at least one lower second contact electrically coupled to, and positioned to provide a lower open area relative to, the lower first contact for electrically engaging a lower surface of a respective second wire.

BRIEF DESCRIPTION OF THE DRAWINGS

This invention may be clearly understood by reference to the attached drawings in which.

DESCRIPTION OF THE PREFERRED EMBODIMENT

Figure 1:
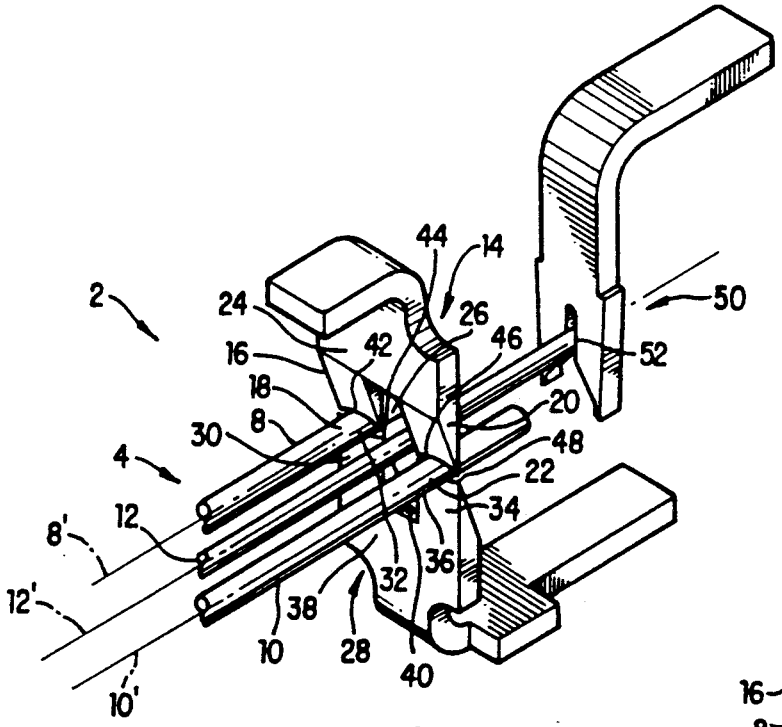
FIG. 1 is a view of one embodiment of the present invention showing use with non-insulated wire leads.
Figure 2:
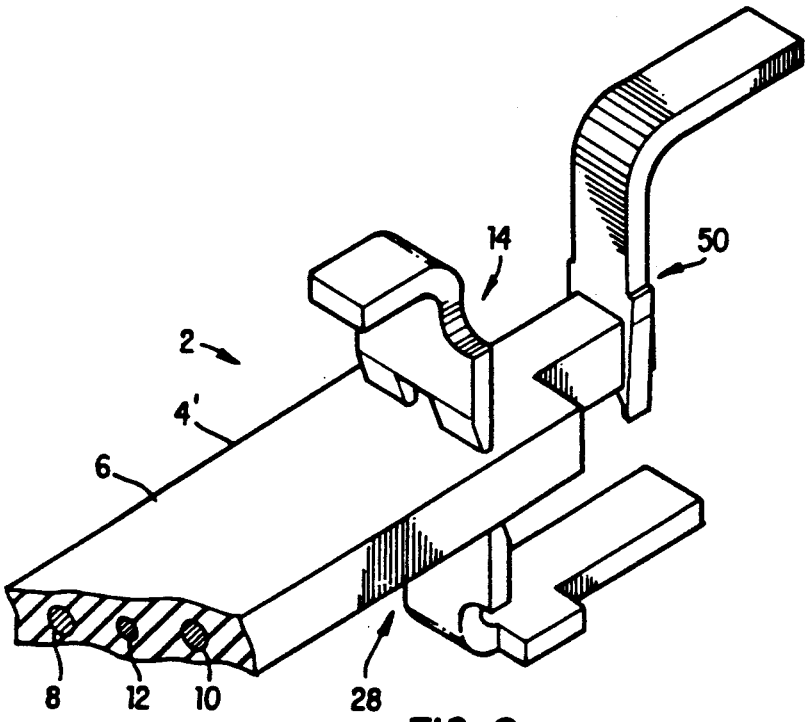
FIG. 2 is a view of the embodiment of FIG. 1 showing use with insulated wire leads.

The embodiment of this invention which is illustrated in the drawings is particularly suited for achieving the objects of this invention. FIGS. 1 and 2 depict a connector 2 for use with at least one multiple wire cable 4, 4'. The multiple wire cable 4 of FIG. 1 does not include insulation. The multiple wire cable 4' of FIG. 2 includes insulation 6. Both multiple wire cables 4, 4' are of the type which include a first wire 8 and a second wire 10 which are separated by a third wire 12. In the embodiment of FIGS. 1 and 2 the connector 2 is in the form of an insulation displacement connection (IDC) contact which has the ability to be electrically connected to two wire leads such as leads 8, 10 which are separated by a third wire lead 12. For example, the leads 8, 10 on either side of a signal wire lead 12 of a standard flat cable or of a tri-lead cable.

The connector 2 includes an upper connector means 14 positioned within a housing. In order to simplify the drawings, the housing is not depicted in FIGS. 1 and 2. However, a housing of the type depicted in FIGS. 3 and 4 can be modified for use with a reduced number of connector means of the type depicted in FIGS. 1 and 2, if desired. Or, an alternative housing can be used. Upper connector means 14 includes at least one upper first contact 16 for electrically engaging an upper surface 18 of a respective first wire 8 and at least one upper second contact 20 for electrically engaging an upper surface 22 of a respective second wire 10. Such structure is depicted in FIG. 1. An identical configuration exists in FIG. 2 but is not visible in the drawing in that such electrical engagement occurs within the insulation 6 of the cable 4'. The upper second contact 20 is mated; that is, electrically coupled to, the upper first contact 16 by means of a bridging segment 24 of the upper connector mean 14. The upper second contact 20 is positioned to provide an upper open area 26 relative to the upper first contact 16. The third wire 12 extends through the upper open area 26 when the connector 2 is assembled with the multiple wire cable 4, 4' as depicted in FIGS. 1 and 2.

In a like manner, the connector 2 includes a lower connector means 28 positioned within the housing. Lower connector means 28 includes at least one lower first contact 30 for electrically engaging a lower surface 32 of a respective first wire 8 and at least one lower second contact 34 for electrically engaging a lower surface 36 of a respective second wire 10. Such structure is depicted in FIG. 1. An identical configuration exists in FIG. 2 but is not visible in the drawing in that such electrical engagement occurs within the insulation 6 of the cable 4'. The lower second contact 34 is mated that is, electrically coupled, to the lower first contact 30 by means of a bridging segment 38 of the lower connector means 28. The lower second contact 34 is positioned to provide a lower open area 40 relative to the lower first contact 30. The third wire 12 also extends through the lower open area 40 when the connector 2 is assembled with the multiple wire cable 4, 4' as depicted in FIGS. 1 and 2. The contacts 16, 20 and 30, 34 provide the IDC portion of the connector.

Figure 1A:
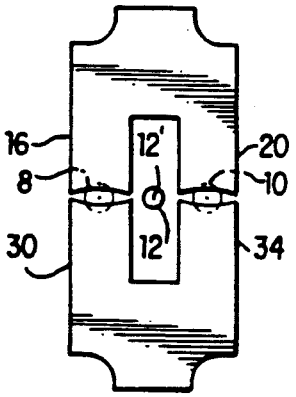
FIG. 1A is a diagrammatic end view of FIG. 1.

As depicted in FIG. 1, upper connector means 14 can be positioned relative to lower connector means 28 such that first wire 8 will be pinched between upper first contact 16 and lower first contact 30, and second wire 10 will be pinched between upper second contact 20 and lower second contact 34 when the connector 2 is assembled with a multiple wire cable. As best depicted in FIG. 1A, each contact means will have two contact areas positioned to avoid interfering with a third wire 12 which passes between the leads 8, 10 being mated.

In the preferred embodiment, means is provided associated with each upper contact and each lower contact for facilitating the positioning of a respective wire between a respective upper contact and a respective lower contact for effecting the electrical connection therebetween. For example, in the embodiment of FIG. 1 facilitating means is provided which includes opposing pairs of wire engaging surfaces 42, 44 and 46, 48 each of which has a concave configuration. Preferably, upper wire engaging surfaces 42, 46 of each upper contact 16, 20, respectively, is a mirror image of a respective wire engaging surface 44, 48 of each lower contact 30, 34, respectively. In this manner, the shape of the wire contact area can be configured to compensate for variations in the placement of the wire leads in the insulation 6. In the preferred embodiment, each upper contact and each lower contact includes means for piercing cable insulation 6 of the multiple wire cable 4' and electrically engaging a respective wire 8, 10. For example, each wire engaging surface 42, 44 and 46, 48 can include a cutting edge which will pierce the cable insulation 4' and electrically engage a respective wire 8, 10. Preferable surfaces 42, 44 and 46, 48 will also penetrate wires 8, 10, respectively. In the embodiment of FIG. 1, each upper first contact 16 and each lower first contact 30 extend in a direction which is perpendicular to the axis 8' of wire 8, and each upper second contact 20 and each lower second contact 34 extend in a direction which is perpendicular to the axis 10' of wire 10.

Figure 3:
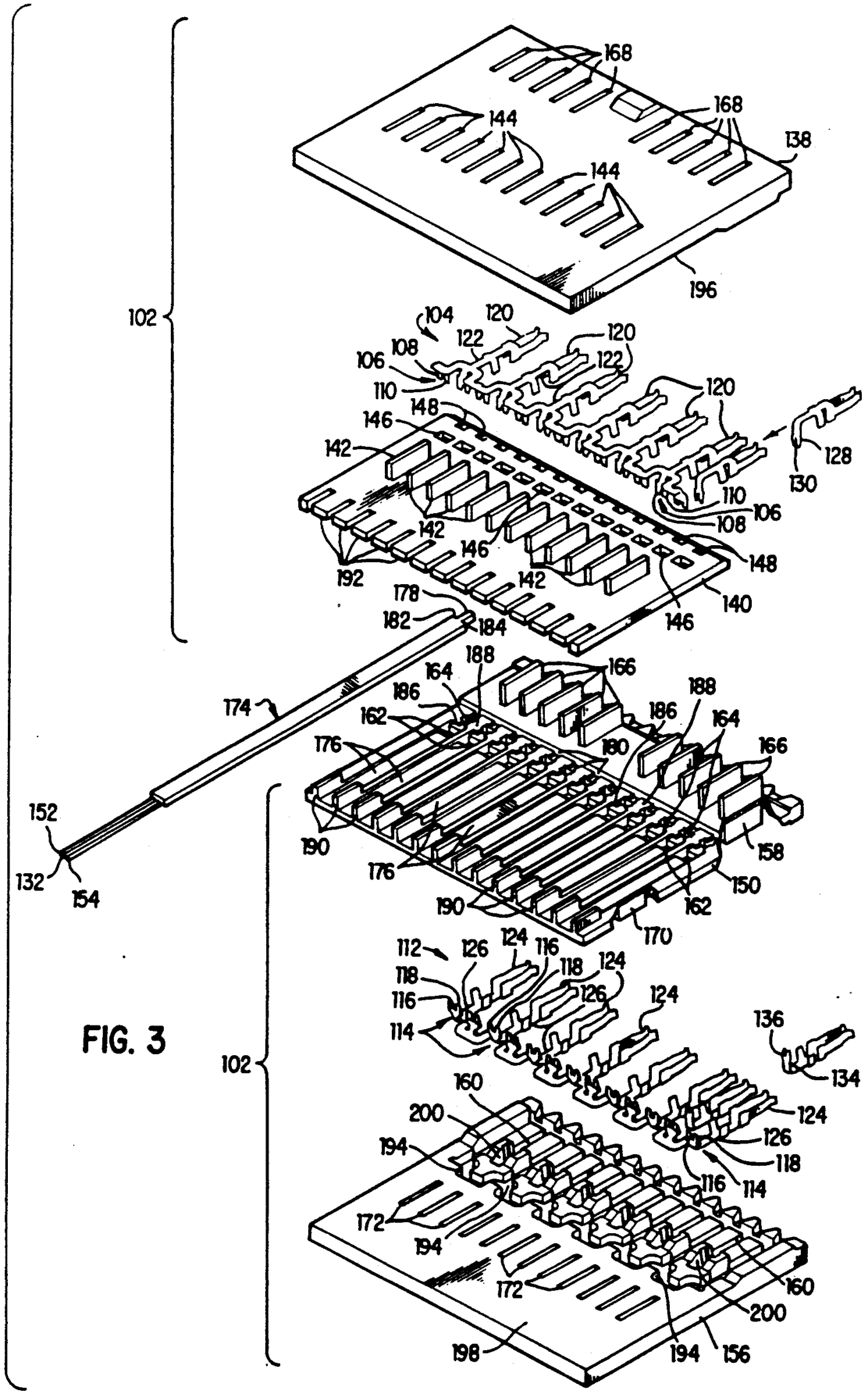
FIG. 3 is an exploded view of an alternate embodiment of the present invention.
Figure 4:
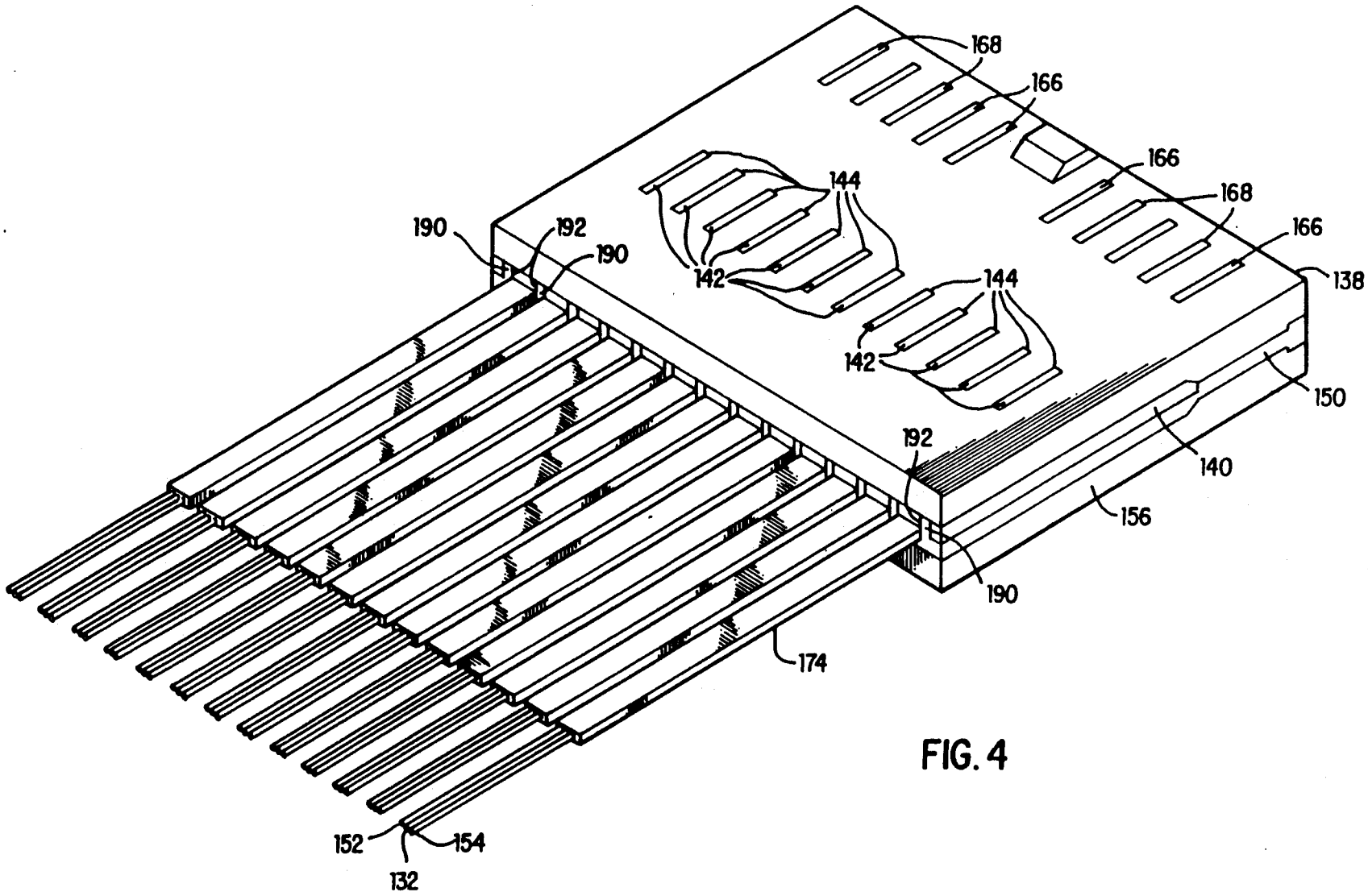
FIG. 4 is the embodiment of FIG. 3 fully assembled.
Figure 5:
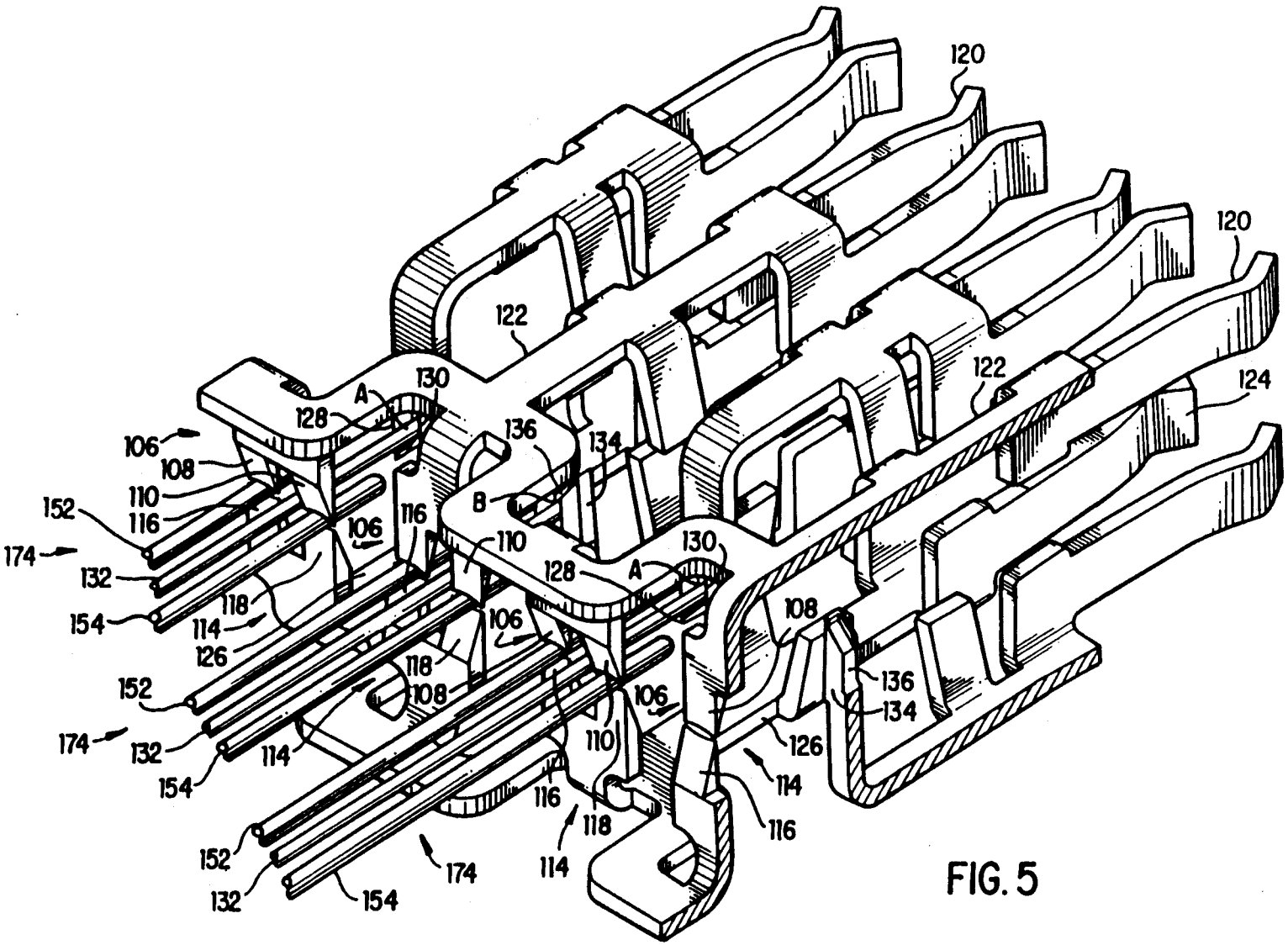
FIG. 5 is a view of contacts of the type depicted in FIG. 3.

In the embodiment of FIGS. 3 to 5 a connector 102 is provided wherein an upper connector means 104 includes a plurality of upper pairs 106 of upper first contacts 108 and upper second contacts 110. In a like manner, connector 102 is provided with a lower connector means 112 which includes a plurality of lower pairs 114 of lower first contacts 116 and lower second contacts 118. Standard-type connectors can be incorporated with the contacts to make additional electrical connections. For example, and with particular reference to FIGS. 3 and 5, in the preferred embodiment the plurality of upper pairs 106 are bussed together, and every other upper pair 106 includes a terminal 120 electrically connected to a respective upper first contact 108 and upper second contact 110 by a bridging segment 122. Similarly, the plurality of lower pairs 114 are bussed together, and every other lower pair includes a terminal 124 electrically connected to a respective lower first contact 116 and lower second contact 118 by a bridging segment 126. In the embodiment of FIGS. 3 to 5, the plurality of upper pairs 106 is offset relative to the plurality of lower pairs 114 such that an upper pair 106 having a terminal 120 will form a biting nip with a lower pair 114 not having a terminal 124. In a like manner, an upper pair 106 not having a terminal 120 will form a biting nip with a lower pair 114 having a terminal 124.

In a preferred embodiment, the connector also includes at least one upper third contact. For example, in the embodiment of FIGS. 1 and 2, the connector 2 includes an upper third contact 50. The upper third contact 50 has a wire engaging surface 52 disposed along a line such as axis 12' which extends between upper first contact 16 and upper second contact 20 as depicted in FIG. 1A for electrically engaging the third wire 12. When the connector 2 is used with the insulated multiple wire cable 4' of FIG. 2, the wire engaging surface 52 will include a cutting edge for piercing the cable insulation 6 and electrically engaging the wire 12.

The connector 2 can include at least one similar lower third contact which includes a wire engaging surface disposed along a line such as axis 12' which also extends between lower first contact 30 and lower second contact 34 as depicted in FIG. 1A for electrically engaging the third wire 12. Although not depicted in FIG. 1, such lower third contact is depicted in FIGS. 3 and 5 as discussed below.

The embodiment of FIGS. 3 to 5 includes a plurality of contacts. In order to simplify the drawings, FIG. 5 depicts the various contacts in place with the insulation removed from cables 174 and with the housing removed. The embodiment of FIGS. 3 to 5 can be used with insulated cables such as are depicted in FIG. 2 or non-insulated cables as depicted in FIG. 1.

FIGS. 3 to 5 depict a plurality of upper third contacts 128 each having a wire engaging surface 130. A respective wire engaging surface 130 is disposed between alternate pairs of upper contacts 108, 110 for electrically engaging a respective third wire 132 as best depicted at A in FIG. 5. In a like manner, a plurality of lower third contacts 134 is provided each having a wire engaging surface 136. A respective wire engaging surface 136 is disposed between alternate pairs of lower contacts for electrically engaging a respective third wire 132 as best depicted at B in FIG. 5.

The connector of the present invention is contained in a housing when in use. For example, the embodiment of FIGS. 3 and 4 depicts a housing including an upper housing component 138 and an upper strain relief component 140 which are configured to mate with each other. Elongated protuberances 142 are provided which extend through elongated apertures 144 when the connector is assembled as depicted in FIG. 4. In such embodiment, the plurality of pairs 106 of upper contacts 108, 110 and each upper third contact 128 are sandwiched between upper housing component 138 and upper strain relief component 140. In such assembly, each upper first contact 108 and each upper second contact 110 extend through an upper aperture 146, and each upper third contact 128 extends through a respective upper aperture 148. Apertures 146 and 148 extend through the upper strain relief component 140. Contacts 108, 110 and 128 extend through such upper apertures to electrically engage wires 152, 154 and 132, respectively, from the top when viewing FIG. 3.

The housing of FIGS. 3 and 4 also includes a lower housing component 156 associated with lower strain relief component 150. Components 156 and 150 are configured to mate with each other. Elongated protuberances 158 are provided extending from the bottom of lower strain relief component 150 (only one is shown) similar to the manner in which protuberances 166 extend from the top of lower strain relief component 150. Each protuberance 158 extends through an elongated aperture 160 when the connector is assembled as depicted in FIG. 4. In such embodiment, the plurality of pairs 114 of lower contacts 116, 118 and each lower third contact 134 are sandwiched between lower housing component 156 and lower strain relief component 150. In such assembly, each lower first contact 116 and each lower second contact 118 extend through a lower aperture 162 and each lower third contact 134 extends through a respective lower aperture 164. Apertures 162 and 164 extend through the lower strain relief component 150. Contacts 116, 118 and 134 extend through such lower apertures to electrically engage wires 152, 154 and 132, respectfully, from the bottom when viewing FIG. 3.

To further facilitate assembly of the housing of FIGS. 3 and 4, a plurality of elongated protuberances 166 extend from the lower strain relief component 150 and mate with corresponding elongated apertures 168 in the upper housing component 138, and a plurality of elongated protuberances 170 extend from the bottom of lower strain relief component 150 (only one is shown) similar to the manner in which protuberances 142 extend from the top of upper strain relief component 140 and mate with corresponding elongated apertures 172 in the lower housing component 156.

The housing of FIGS. 3 and 4 further includes means associated with components 138, 140, 150 and 156 for holding in place a plurality of multiple wire cables 174 between the upper and lower strain relief components for facilitating electrical connection of the plurality of pairs of upper contacts 106 and the plurality of pairs of lower contacts 114 with respective first wires 152 and second wires 154, and for facilitating electrical connection of the upper third contacts 128 and the lower third contacts 134 with respective third wires 132. Regarding the holding in place of a plurality of multiple wire cables 174 between the upper and lower strain relief components, FIG. 3 depicts a plurality of cable enclosing grooves 176 each configured to receive a cable 174. Each groove 176 extends from an edge of the component 150 to respective lower apertures 162, 164. The end 178 of the cable 174 is at the end of the third wire 132 and engages an abutment 180 of the groove 176. Shoulders 182, 184 of cable 174 are at the end of wires 152, 154, respectively, and abut against shoulders 186, 188 of the groove 176. Each cable groove 176 has a first width, adjacent to and extending from an edge of the lower strain relief component, which is substantially equal to the width of a respective multiple wire cable 174 so that cable 174 will fit snugly into such groove 176, and a second width, adjacent lower apertures 164, which is less than the first width to snugly accommodate a respective third wire 132. The lower strain relief component 150 also includes a plurality of rectangular protuberances 190, and the upper strain relief component 140 includes a plurality of corresponding rectangular apertures 192. In assembling the housing, each cable 174 is positioned within a respective channel 176 such that end 178 engages abutment 180 and shoulders 182, 184 abut respective shoulders 186, 188. The cables 174 are then held in place between the upper and lower strain relief members by positioning the upper component 140 upon the lower contact 150 such that protuberances 190 extend through apertures 192 as depicted in FIG. 4.

Regarding facilitating electrical connection of the plurality of pairs of upper contacts 106 and the plurality of pairs of lower contacts 114 with respective wires 152 and 154, the upper and lower housing components 138, 156 are provided with alignment grooves. In particular, lower housing component 156 is provided with alignment grooves 194. The plurality of pairs of lower contacts 114 are disposed within alignment grooves 194 which are positioned such that each pair of contacts 116, 118 will extend through an aperture 162 and electrically engage a wire 152, 154, respectively, such electrical engagement being depicted in FIG. 5. The surface 196 of upper housing component 138 is a mirror image of the surface 198 of the lower housing component 156 and includes identical alignment grooves (not shown) into which the plurality of pairs of upper contacts 106 are disposed such that each pair of contacts 108, 110 will extend through an aperture 146 and electrically engage a wire 152, 154, respectively, such electrical engagement being depicted in FIG. 5.

Regarding facilitating electrical connection of each upper third contact 128 and each lower third contact 134 with a respective third wire 132, the upper and lower housing components 138, 156 are also provided with alignment grooves. In particular, lower housing component 156 is provided with alignment grooves 200. Each lower contact 134 is disposed within an alignment groove 200 which is positioned such that a wire engaging surface 136 of each lower third contact 134 will extend through an aperture 164 and electrically engage a wire 132, such electrical engagement being depicted in FIG. 5. The surface 196, being a mirror image of the surface 198, includes identical alignment grooves (not shown) into which each upper contact 128 is disposed such that a wire engaging surface 130 of each upper contact 128 will extend through an aperture 148 and electrically engage a wire 132, such electrical engagement being depicted in FIG. 5. When the housing is assembled as depicted in FIG. 4, the various components 138, 140, 150, 156 can be held together by an adhesive such that each cable 174 is held in place between the strain relief components, the upper and lower pairs of contacts 106, 114 are held in place and caused to be in electrical engagement with respective first and second wires 152, 154, and the upper and lower third contacts 128, 134 are held in place and caused to be in electrical engagement with respective third wires 132.

It will be apparent to those skilled in the art that cables 174 can include insulation such as the insulation 6 of cable 4' of FIG. 2 or can be without insulation such as the cable 4 which includes wires 8, 10 and 12 as depicted in FIG. 1.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. A connector for use with multiple wires which comprise at least two wires, comprising:

a housing;

an upper connector means positioned within said housing and including at least one upper first contact for electrically engaging an upper surface of a respective first wire, and at least one upper second contact electrically coupled to, and positioned to provide an upper open area relative to, said upper first contact for electrically engaging an upper surface of a respective second wire; and a lower connector means positioned within said housing and including at least one lower first contact for electrically engaging a lower surface of a respective first wire, and at least one lower second contact electrically coupled to, and positioned to provide a lower open area relative to, said lower first contact for electrically engaging a lower surface of a respective second wire.

2. The connector of claim 1 wherein said upper connector means is positioned relative to said lower connector means such that each first wire will be pinched between each upper first contact and each lower first contact, and each second wire will be pinched between each upper second contact and each lower second contact, when said connector is assembled with a multiple wire cable.

3. The connector of claim 2 wherein each upper contact and each lower contact includes means for piercing cable insulation of said multiple wire cable and electrically engaging a respective wire.

4. The connector of claim 2 wherein each upper first contact and each lower first contact extend in a direction which is perpendicular to the axis of said first wire, and further wherein each upper second contact and each lower second contact extend in a direction which is perpendicular to the axis of said second wire.

5. The connector of claim 2 further including means associated with each upper contact and each lower contact for facilitating the positioning of a respective wire between a respective upper contact and a respective lower contact for effecting an electrical connection therebetween.

6. The connector of claim 5 wherein each facilitating means includes a wire engaging surface having a concave configuration.

7. The connector of claim 6 wherein each wire engaging surface includes a cutting edge for piercing cable insulation of said multiple wire cable and electrically engaging a respective wire.

8. The connector of claim 6 wherein said wire engaging surface of each upper contact is a mirror image of a respective wire engaging surface of each lower contact.

9. The connector of claim 8 wherein each wire engaging surface includes a cutting edge for piercing cable insulation of said multiple wire cable and electrically engaging a respective wire.

10. The connector of claim 1 wherein said upper connector means includes a plurality of pairs of upper first and upper second contacts, and further wherein said lower connector means includes a plurality of lower pairs of lower first and lower second contacts.

11. The connector of claim 10 wherein said plurality of upper pairs are bussed together and every other upper pair of said plurality of upper pairs includes a terminal electrically connected to a respective upper first and second contact, and further wherein said plurality of lower pairs are bussed together and every other lower pair of said plurality of lower pairs includes a terminal electrically connected to a first and second contact, said plurality of upper pairs being offset relative to said plurality of lower pairs such that an upper pair having a terminal will form a biting nip with a lower pair not having a terminal.

12. The connector of claim 1 further including at least one upper third contact positioned within said housing, each upper third contact having a wire engaging surface disposed about a line which extends between a respective upper first contact and a respective upper second contact for electrically engaging a respective third wire.

13. The connector of claim 12 further including at least one lower third contact positioned within said housing, each lower third contact having a wire engaging surface disposed about a line which extends between a respective lower first contact and a respective lower second contact for electrically engaging a respective third wire.

14. The connector of claim 1 wherein said at least one upper connector means includes a plurality of pairs of upper contacts, each pair of upper contacts including an upper first contact and an upper second contact, and further wherein said at least one lower connector means includes a plurality of pairs of lower contacts, each pair of lower contacts including a lower first contact and a lower second contact, further including a plurality of upper third contacts positioned within said housing, each upper third contact of said plurality of upper third contacts having a wire engaging surface which is disposed about a line which extends between an alternate pair of upper contacts, and further including a plurality of lower third contacts positioned within said housing, each lower third contact of said plurality of lower third contacts having a wire engaging surface which is disposed about a line which extends between an alternate pair of lower contacts, every other pair of said plurality of pairs of upper contacts including a terminal electrically connected to a respective upper first and second contact, and every other pair of said plurality of pairs of lower contacts including a terminal electrically connected to a respective lower first and second contact, each upper pair having a terminal forming a biting nip with each lower pair not having a terminal.

15. The connector of claim 14 wherein said plurality of pairs of upper first and second contacts are bussed together, and further wherein said plurality of pairs of lower first and second contacts are bussed together.

16. The connector of claim 14 wherein said housing comprises:

an upper housing component and an upper strain relief component configured to mate with each other, said plurality of pairs of upper contacts and each upper third contact being sandwiched between said upper housing component and said upper strain relief component, each upper first, second and third contact extending through respective upper apertures which extend through said upper strain relief component toward a lower strain relief component;

a lower housing component and a lower strain relief component configured to mate with each other, said plurality of pairs of lower contacts and each lower third contact being sandwiched between said lower housing component and said lower strain relief component, each lower first, second and third contact extending through respective lower apertures which extend through said lower strain relief component toward an adjacent upper first, second and third contact; and means associated with said upper strain relief component, said lower strain relief component, said upper housing component and said lower housing component for uniting said upper strain relief component and said lower strain relief component between said upper housing component and said lower component, for holding in place a plurality of said multiple wire cables between said upper strain relief component and said lower strain relief component, for facilitating electrical connection of said plurality of pairs of upper contacts and said plurality of pairs of lower contacts with respective of said first wires and said second wires, and for facilitating electrical connection of said upper third contacts and said lower third contacts with respective of said third wires.

17. The connector of claim 16 wherein said upper housing component includes a plurality of first grooves, said plurality of pairs of upper contacts and each upper third contact being disposed in a respective first groove of said plurality of first grooves, and further wherein said lower housing component includes a plurality of second grooves, said plurality of pairs of lower contacts and each lower third contact being disposed in a respective second groove of said plurality of second grooves.

18. The connector of claim 17 wherein said lower strain relief component includes a plurality of cable enclosing grooves each of which extends from an edge of said lower strain relief component to a respective of said lower apertures.

19. The connector of claim 18 wherein each cable enclosing groove has a first width adjacent to and extending from said edge, said first width being substantially equal to the width of a respective multiple wire cable, and a second width adjacent a respective lower aperture, said second width being less than said first width to accommodate a respective third wire of said respective multiple wire cable.

* * * * *